United States Patent [19]

Sleder

[11] 4,160,435

[45] Jul. 10, 1979

[54] ALTERNATOR DRIVEN CD IGNITION WITH AUXILIARY POWER

[75] Inventor: Richard L. Sleder, Fond Du Lac, Wis.

[73] Assignee: Brunswick Corporation, Skokie, Ill.

[21] Appl. No.: 787,770

[22] Filed: Apr. 15, 1977

[51] Int. Cl.[2] ..... F02P 1/02; H05B 41/36

[52] U.S. Cl. ..... 123/148 CC; 123/149 D; 315/209 CD

[58] Field of Search ..... 123/148 CC, 148 DS, 123/148 E, 149 D; 315/209 CD, 209 SC; 310/70 A, 70 R, 153, 156, 74

[56] References Cited

U.S. PATENT DOCUMENTS

| | | | |
|---|---|---|---|
| 3,317,765 | 5/1967 | Cone | 310/74 |
| 3,623,467 | 11/1971 | Piteo | 123/148 CC |
| 3,673,490 | 6/1972 | Magrane | 123/149 D |
| 3,732,483 | 5/1973 | Katsumata | 123/149 D |
| 3,805,759 | 4/1974 | Fitzner | 123/148 CC |
| 3,828,754 | 8/1974 | Carlsson | 123/148 CC |
| 3,937,200 | 2/1976 | Sleder et al. | 123/148 CC |
| 4,054,113 | 10/1977 | Sleder et al. | 123/148 CC |

*Primary Examiner*—Charles J. Myhre
*Assistant Examiner*—P. S. Lall
*Attorney, Agent, or Firm*—Eugene R. Sawall; Lewis L. Lloyd

[57] ABSTRACT

An engine flywheel forms the common rotor for a dual alternator unit having a first ignition alternator for the ignition circuit and a second power alternator for battery charging and providing other auxiliary power. The rotor includes first and second closely, axially spaced permanent annular magnets. An ignition and trigger coil assembly is aligned with one magnet and an auxiliary power coil with the second. The power magnet and coil include a substantial number of magnetic poles and coils to produce a significant power output. In a two cylinder engine, the ignition magnet has two radially and oppositely polarized poles. A pair of ignition capacitor charging coils are spaced by 180° with a trigger coil mounted therebetween and circumferentially movable to adjust the timing. First and second ignition capacitors are connected to the charging coil and to the spark plugs and are alternately charged and discharged. The power alternator has a fourteen pole magnet and a five coil winding to produce 60 watts of auxiliary power. The power magnet has an even number of magnetic poles such that the leakage flux into the trigger coil generates a ripple voltage which has a symmetrical effect on the trigger signal to maintain good timing symmetry between the several cylinders.

21 Claims, 6 Drawing Figures

ALTERNATOR DRIVEN CD IGNITION WITH AUXILIARY POWER

BACKGROUND OF THE INVENTION

This invention relates to an alternator apparatus for powering a capacitor discharge ignition system for internal combustion engines and auxiliary electrical equipment and particularly to such apparatus for a two cylinder engine designed for application to outboard motor units and the like.

Capacitor discharge ignition systems have been developed for application in internal combustion engines and have particularly been employed in connection with propulsion devices such as outboard motors, snowmobiles, motorcycles and similar vehicles.

Generally, the capacitor discharge ignition systems employ one or more firing capacitors. Suitable control switch means such as controlled rectifiers connect the capacitor or capacitors to the spark plugs for discharging of the capacitor and firing of the engine. The alternator is constructed and connected for charging the capacitor and for generating the triggering pulses for firing the controlled rectifiers.

The ignition system, particularly for smaller outboard engines and the like, is advantageously powered from an engine driven alternator unit. Space limitation generally requires a relatively small, compact, lightweight construction. The alternator unit may be conveniently incorporated into the flywheel structure of the engine. The flywheel is formed as a cup-shaped member secured to the engine shaft with a rotor means secured within the skirt. A stator coil assembly is mounted in fixed relation to the engine with appropriate coils coupled to the rotor means. The rotor means includes suitable permanent magnet members with spaced flux reversal points or portions to provide appropriate coupling to the stator assembly for generating appropriate charging power to the ignition capacitor and appropriate trigger signals for discharging thereof at the proper time.

In one system for a two cylinder engine, a pair of ignition capacitors are connected to be alternately charged from a charging coil unit and alternately discharged from a separate trigger coil unit.

In many engine driven propulsion devices, auxiliary electrical devices such as lights, starters, a battery and the like are provided. An alternator unit is preferably constructed and connected to provide a rectified voltage output for charging of the battery or an A.C. voltage output for operating lights. Although separate alternator units may be provided, a single integrated assembly is desirable, particularly where severe space limitations are encountered, such as in small outboard motor units.

Although compact alternator units have been suggested, the location of the various functioning coils within a common compact and integrated construction tends to create cross-coupling between the several signal generating systems and in particular may cause improper or undesired ignition. Although such systems do, therefore, provide improved engine operation, a high degree of reliability and maximum efficiency of operation is often not obtained, particularly in the small, compact constructions.

SUMMARY OF THE PRESENT INVENTION

The present invention is particularly directed to a compact, lightweight dual alternator unit including a common rotor support and having a first ignition section or alternator means for powering the ignition circuit and a second power section or alternator means mounted immediately adjacent the first section and constructed for providing auxiliary power suitable for battery charging or A.C. lighting.

Generally, the alternator unit includes an annular rotor having first and second closely, axially spaced magnetic field means. A stator assembly is mounted in relatively fixed relation within an annular rotor, and includes an ignition coil unit including a charging and trigger coil means aligned with the first magnetic field means and an auxliary power winding in alignment with the second magnetic field means. The ignition coil unit may include two or more charging windings and a single trigger winding for charging of the capacitor means and gating of the switch means for firing of each cylinder. The auxiliary power magnet and winding includes a substantial number of magnetic poles and coils to produce a significant power output of a generally high frequency compared to the ignition firing rate. For example, in one embodiment for a two cylinder engine a fourteen pole field and a five coil winding produced an alternating output which, when rectified, was at a level of 50 watts of D.C. power or 60 watts of A.C. power unrectified.

The magnetic poles of the auxiliary section are selected such that leakage flux from the auxiliary section generates a ripple voltage in the trigger coil means of the ignition section which, in accordance with one significant aspect of this invention, has a symmetrical effect on the trigger signal to maintain good timing symmetry between the several cylinders and does not function in such a manner as to lock a gated or triggered control switch such as a control rectifier into conduction.

In a novel embodiment of this invention for a two cylinder engine, the ignition circuit generally includes first and second ignition capacitors connected to the charging coil means through a suitable rectifying diode network and to the spark plugs in series with a discharge switch such as a controlled rectifier, such as shown in U.S. Pat. No. 3,937,200. A trigger coil means is connected to the gate means for alternate discharging of the capacitors to alternately fire the cylinders. The capacitor charging rotor includes two permanent magnets secured within an annular support such as the flange of a cup-shaped flywheel and each extends for approximately 180°, with small neutral zones or effective air gaps between the adjacent ends. The two magnets are radially and oppositely polarized to develop a working gap from the magnet to the coil stator in a radial direction. The stator includes a core having a pair of ignition capacitor charging coils mounted on core poles spaced by 180°. A trigger coil is mounted between the charging coils and circumferentially movable to adjust the coupling to the neutral zones of the ignition magnets for control of the timing. As the flywheel rotates, opposite polarity pulses are generated in the charging coils every 180° of crankshaft rotation to alternately charge the capacitors, and similarly opposite polarity trigger pulses, separated by 180°, are generated to discharge a previously charged capacitor. The trigger coil was mounted for about 60° of ignition timing adjustment. Even with the maximum advance, essentially 270° of crankshaft rotation is available for charging of the ignition capacitors, which provides ample time for charging of the ignition capacitors to the maximum voltage level throughout the normal range of speed and timing for an outboard motor engine. The power magnet poles are equicircumferentially located in the second section of the rotor, with radial and alternate opposite polarization of the poles. The power winding coils are grouped togehter and wound on projecting poles of an arcuate core segment with poles and coils spaced for alignment with the correspondingly spaced magnetic poles of the second field means to form an arcuate assembly. The two pole ignition field is secured coaxially of the power field with the two neutral zones aligned between, and preferably centrally of, two adjacent poles of the power field. In a particular embodiment, a fourteen pole rotor and a five coil stator were provided. The fourteen poles induced a symmetrical signal in the trigger coil which maintained the symmetrical timing. A significant feature of this invention is the adaptability to production line manufacture of manual or non-electric models without a power section and the electric models by proper magnetization of one or two levels. Additionally, a manual and/or non-powered model outboard unit may be changed by providing of a kit including the dual stator assemblies and magnetization of the power field section. Applicant has found that the present invention provides a reliable and relatively inexpensive dual alternator unit for producing power to a capacitor discharge ignition system and operating power to auxiliary equipment in a compact assembly.

BRIEF DESCRIPTION OF THE DRAWINGS

The drawings furnished herewith illustrate a preferred construction of the present invention in which the above advantages and features are clearly disclosed as well as others which will be readily understood from the following description of such embodiment.

In the drawings.

DESCRIPTION OF ILLUSTRATED EMBODIMENT

Figure 1:
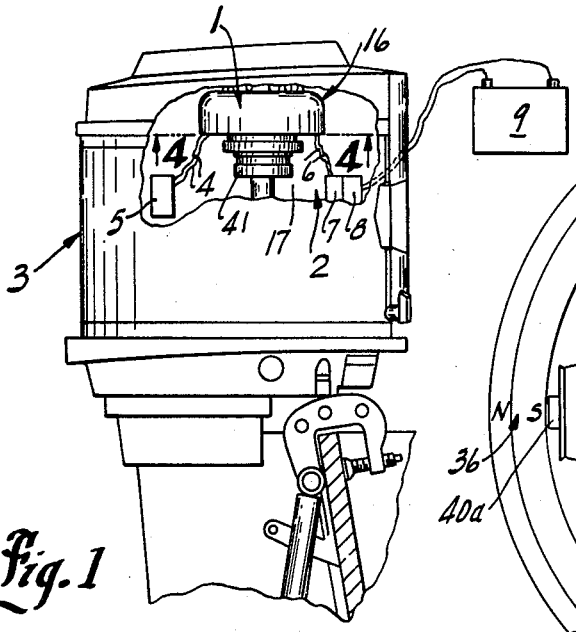
FIG. 1 is a diagrammatic view of a two cylinder internal combustion engine such as employed in outboard motor unit and constructed in accordance with the present invention with a dual alternator unit having an ignition section and a power section.
Figure 5:
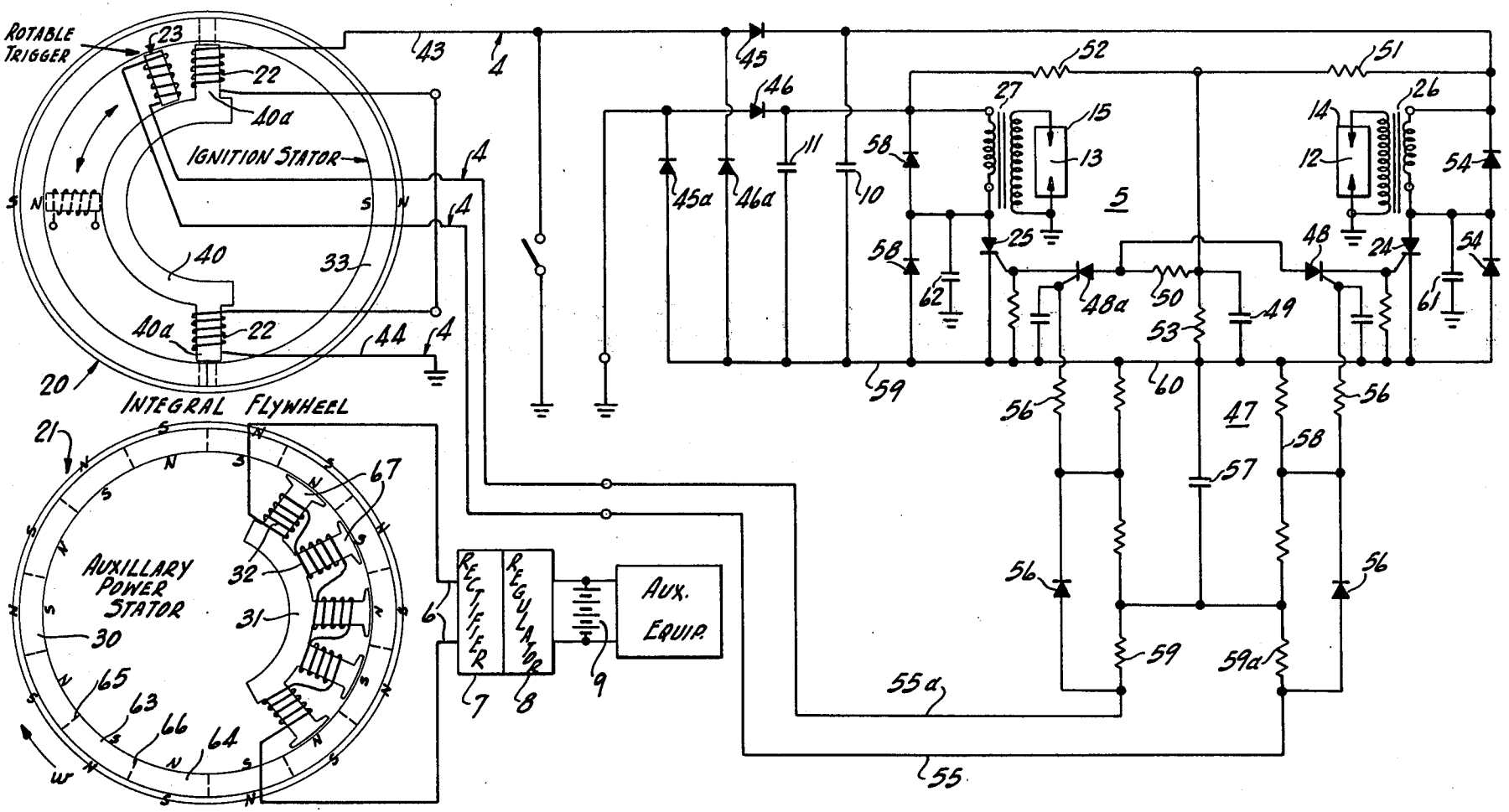
FIG. 5 is a schematic circuit diagram of the electrical system and the dual alternator unit of FIGS. 1–3.

Referring to the drawings and particularly to FIG. 1, the illustrated embodiment of the present invention includes a dual alternator unit 1 directly coupled to a two cylinder engine 2 mounted as the powerhead of an outboard motor unit 3. As shown in FIG. 5, the dual alternator unit 1 includes first output leads 4 connected to an ignition unit 5 for firing of the engine and second output leads 6 connected to auxiliary equipment, shown as a battery charging system including a rectifier 7 or a regulator 8 connected to a battery 9 as well as other auxiliary equipment. The ignition unit 5 is preferably a capacitor discharge system including a pair of ignition capacitors 10 and 11 which are alternately and cyclically charged. as more fully developed hereinafter and which are alternately discharged to the spark plugs 12 and 13 for appropriate firing of two cylinders 14 and 15, once each crankshaft revolution. The dual alternator unit 1 is located within a cup-shaped flywheel 16 immediately adjacent to the engine block 17 to provide a compact assembly particularly adapted to outboard motor units and the like.

Generally, in the illustrated embodiment, the cup-shaped flywheel 16 includes a central hub 18 appropriately keyed or otherwise fixedly secured to the engine crankshaft 19. The alternator unit includes an ignition generator section 20 and a power generator section 21 located in axially spaced relation within the flywheel 16 which functions as a common rotor support. The ignition generator section 20 includes a stator assembly having charging coils 22 connected to charge the capacitors 10 and 11, and a trigger coil 23 connected to alternately actuate switch means shown as control rectifiers 24 and 25 which are connected to discharge the capacitors 10 and 11 through related pulse transformers 26 and 27. The spark plugs 12 and 13 are connected across the secondary of the pulse transformers 26 and 27.

Figure 4:
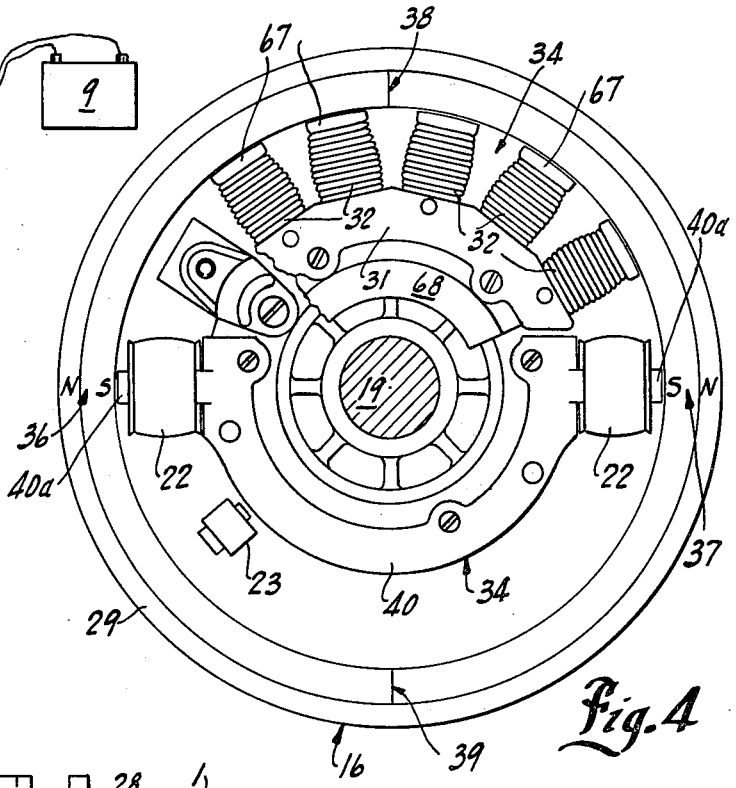
FIG. 4 is a bottom view taken generally on line 4 4 of FIG. 1, with the rotor poles of the power section identified as in FIG. 3.
Figure 2:
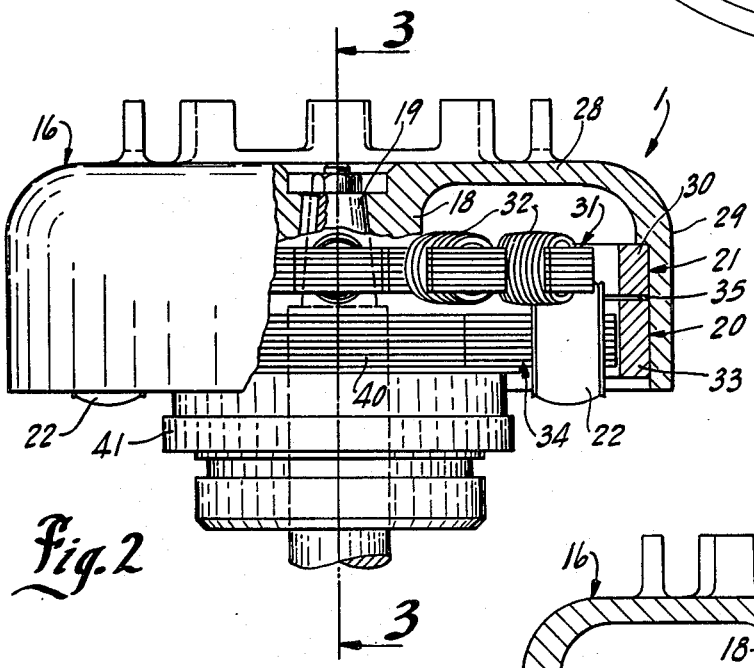
FIG. 2 is a side view of the alternator unit with parts broken away and sectioned.
Figure 3:
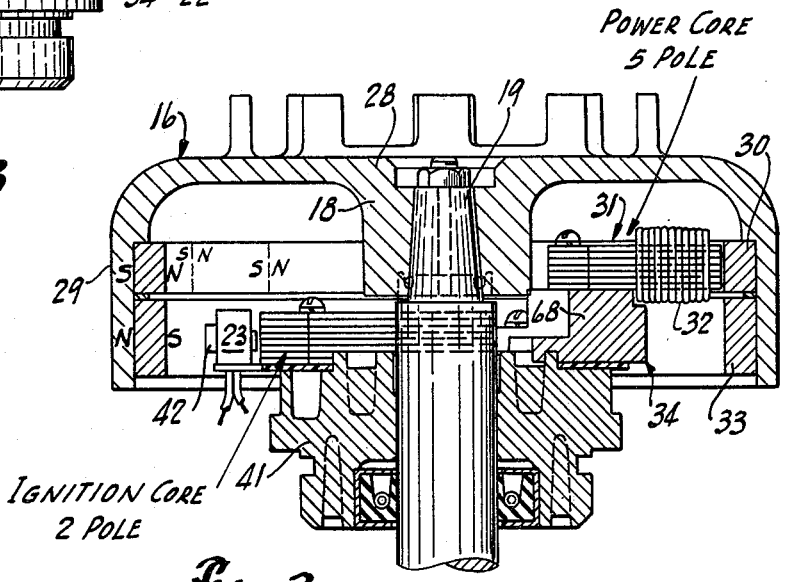
FIG. 3 is a vertical section taken generally on line 3—3 of FIG. 2 and with rotor poles illustrated by the conventional north (N) and south (S) polarity designation.

The invention is particularly directed to the construction of the alternator unit and a preferred embodiment is more clearly illustrated in FIGS. 2–4.

The cup-shaped flywheel 16 includes an outer base portion 28 integrally formed with the hub 18 and an outer, annular skirt 29 in accordance with a generally conventional shape. The power generator section 21 is located immediately adjacent the inner end of the skirt 29. The power generator section 21 includes a rotor 30 formed by a member aligned with a stator assembly 31 which includes power winding or coils 32 connected in series to the pairs of leads 6. The ignition generator section 20 similarly includes a rotor 33 formed by a permanent magent member aligned with a stationary stator assembly 34 including the charging coils 22 and the trigger coil 23.

In the illustrated embodiment, the rotor magnet members may be formed in single magnetic strip, or by similar axially spaced strips, by appropriate polarization in the plane of the respective sections 20 and 21, and to the opposite sides of neutral zone or plane 35 between such sections. The magnet strip may be formed of a suitable magnetic plastic, such as 3M Plastiform material manufacuted and sold by Minnesota Manufacture and Mining Company of Minnesota, and adhesively bonded to skirt 29 if the flywheel is formed of a magnetic steel. If not, a separate magnetic strip, not shown, would be interposed to serve as a flux return path. The magnetic fields of the power section 21 and the ignition section 20 are closely spaced. The power section 21 generates a relatively high frequency alternating field which, due to the proximity of the stator sections, will induce a ripple voltage in the trigger coil 23. The magnet unit of section 21 is specially constructed to induce a symmetrical signal in coil 23 to maintain proper timing.

More particularly, in the illustrated embodiment of the invention, the outer vertical level magnet strip 33 forming a part of the ignition generator section 20 is spot magnetized, radially of the rotor, to define two distinct, circumferential magnets as shown diagrammatically at 36 and 37, in FIGS. 4 and 5. The magnets 36 and 37 are oppositely and preferably radially polarized throughout their length to define a pair of flux reversal locations or junctions 38 and 39 separated by 180°. The junction 38 and 39 may include small neutral or non-magnetic portions or even an air gap where separate magnet members are employed.

The stator unit 34 of the ignition generator section 20 includes a semi-circular laminated core 40 having end poles 40*a*, on which charging windings or coils 22 are wound.

The core 40 is semi-circular such that the coils 22 are spaced from each other by 180° and selectively coupled to the flux reversible junctions 38 and 39 of the permanent magnets 36–37. The core 40 is mounted to a support hub 41 having a central opening through which the crankshaft 19 freely passes. The support 41 is suitably bolted or otherwise attached to the engine block to support the core 40 in fixed aligned relation to the annular magnetic means formed by the magnets 36 and 37.

The trigger coil 23 is wound on a core 42 which is mounted for angular orientation between the stator poles 40*a* for sequential coupling to the flux reversal junctions 38 and 39 such as shown in the U.S. Pat. No. 3,937,200 which issued to Sleder et al on Feb. 10, 1976. A trigger signal is thus generated between the successive charging pulses. Successive triggering signals are of opposite polarity and in the illustrated embodiment function to alternately fire rectifier 24 and 25 for firing of the two cylinders 14 and 15 of engine 2.

As shown in FIG. 5, the charging coils 22 are connected in series aiding between leads 43 and 44, the latter being connected as a common ground. Lead 43 is connected to the topside of capacitor 10 by a blocking diode 45 and the opposite side of capacitor 10 is connected by a diode 45*a* to ground and thus to lead 44. The voltage output of the windings 22 is thus directly connected to charge capacitor 10 when lead 43 is positive. Lead 44 is similarly connected to the topside of capacitor 11, via a diode 46, and lead 44 is connected to the bottom side by a diode 46*a*, to provide charging current to the ignition capacitor 11, with the output polarity of the coils reversed. The flux reversals of the junctions 38 and 39 are in opposite directions with respect to the coils 22 to generate opposite polarity pulses and thereby alternately charge the capacitors 10 and 11, once each complete revolution of engine.

The trigger coil 23 produces a controlled discharge of the fully charged capacitors 10 and 11, and, in particular, is preferably and movably mounted for positioning within the flywheel 16 in any known or desired manner, to develop appropriate trigger pulses related to the position of the piston relative to top dead center for retard or advance firing. Coil 23 is shown mounted in a suitable housing and having a mounting ring which is coupled to a throttle linkage, not shown, such as disclosed in the previously identified U.S. Pat. No. 3,937,200.

Referring particularly to FIG. 5, in the illustrated embodiment of the invention the ignition also includes a trigger stablizing circuit 47 for firing a rectifier 24 and 25. A separate trigger or pilot switch shown as controlled rectifiers 48 and 48*a* is provided for controlling the discharging of the capacitors 10 and 11. The rectifiers 48 and 48*a* have their gate to cathode inputs connected in series with the gate to cathode inputs of the main rectifiers 24 and 25 to turn on either rectifiers 24 and 48 or rectifiers 25 and 48*a*. A firing capacitor 49 in series with a common resistor 50 is connected by rectifiers 48 and 48*a* to rapidly drive rectifiers 24 and 25 fully on. Capacitor 49 is charged from capacitors 10 and 11 through charging resistors 51 and 52 and a common parallel resistor 53. The resistance of the resistors 51 and 52 is high to prevent excessive discharge discharge of the main firing capacitors 10 and 11 and to insure the holding current decreases sufficiently to turn off the pilot rectifier 48 and 48*a* after capacitor 49 discharges. The capacitor 49 is discharged through pilot rectifiers into the gate to cathode junction of the main rectifier 24 or 25 to circuit reference. This turns on the rectifier 24 or 25 and rapidly discharges the energy of related ignition capacitor 10 or 11 through the pulse transformer 26 or 27 and the corresponding spark plug 12 or 13 for firing of the engine. Protective diodes 54 are connected across the rectifiers and transformer primary.

The gates of the rectifiers 48 and 48*a* are connected to the opposite ends of the trigger coil 23 by trigger leads 55 and 55*a* and a series connected steering diode-resistor 56. The capacitive resistive bias and stabilizing network 47 is connected across the trigger coil leads. The network 47 includes a bias stabilizing capacitor 57 to insure a preset, fixed, firing time independent of speed, with the advance and retard setting of the trigger coil 23 separately controlled through the throttle setting. A reverse bias limiting voltage divider branch 58 limits the voltage between trigger periods. This stabilizes the ignition angle generally as taught in U.S. Pat. No. 3,805,759.

In FIG. 5, when the trigger lead 55 is positive, the pulse of coil 23 flows through the lead 55, diode-resistor 56, gate-to-cathode of rectifiers 48 and 24, capacitor 57 and a return resistor 59. When lead 55*a* is positive a similar current pulse turns on rectifiers 48*a* and 25 for discharging of capacitor 11.

The charging and triggering circuit includes a common or reference line 60 connected to ground through the diode 45*a*. RFI suppression capacitors 61 and 62 are connected from the anodes of rectifiers 24 and 25 to the engine block or ground, as shown. The resistors 59 and 59*a* load the pulse to maintain stable timing in the event low leakage impedance occurs between the trigger leads and ground.

The ignition generator section thus generates a charging pulse and a firing pulse in time spaced sequence and in a repetitive manner. Such ignition signals for each cylinder 14 and 15 are generated once each engine revolution for proper firing of a two cylinder, two cycle engine. The particular time of firing is controlled by the physical positioning of the trigger coil 23. The floating or ungrounded output of coil 23 thus provides opposite polarity half cycles or pulses which are operative to alternately fire the two cylinders of engine 2. The cylinders are fired in proper sequence, however, only in response to forward rotation of the engine. If the engine rotation is reversed the rectifiers will be fired 180° out of phase and thus prevent the engine from running backwards.

Referring particularly to FIGS. 2, 4 and 5, the power generating section 21 generally includes the rotor section secured to the inner portion of skirt 29 of the flywheel 16 and includes a plurality of permanent magnets which are oppositely and radially polarized to define first polarity magnets 63 and second opposite polarity magnets 64. The oppositely polarized magnets 63 and 64 also define flux reversal points or areas between the adjacent magnets 63 and 64, and thus at the junctions or adjacent ends 65 and 66. The illustrated permanent magnets 63 and 64 are polarized radially of the rotor, as shown by polarity dots.

Figure 6:
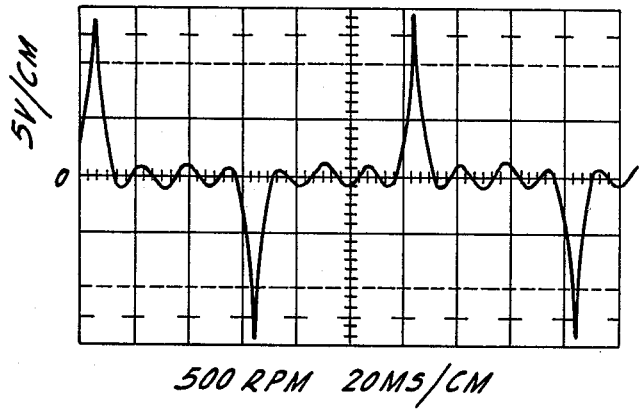
FIG. 6 is a graphical illustration of the output of the generator means of FIGS. 2–4.
Figure 6:
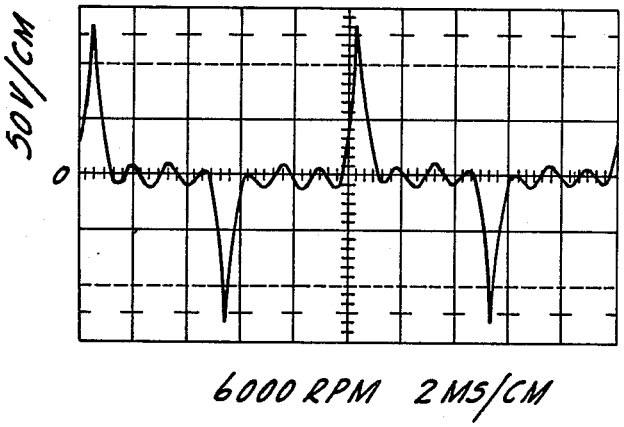

In addition, the generating section 21 includes the stator section 31 attached to the support hub 41 and secured in fixed relation to the engine block 17 and the core 49 of the ignition section 20. The section 21 includes a plurality of angularly spaced power coils, shows as five coils 32. The coils 32 are connected in series aiding, as shown in FIG. 5, to produce an alternating current output of relatively high power level at leads 6 to rectifier 7, for example, 50 watts of rectified power from the rectifier 7. A stator core 31 is provided having five pole members 67 on which the coils 32 are wound. The stator core 31 is a laminated unit having the pole members 67, spaced in accordance with the spacing of five adjacent magnets 63 and 64. Core 31 is suitably attached to the hub 41 to the opposite side of the shaft opening from the stator core 40. Core 31 is mounted on a raised platform 68 of the hub 41 and thus offset from the plane of the ignition stator core 40, with the stator core 31 and coils 32 in the plane of the power permanent magnets 63 and 64 in the assembled unit. The coils 32 are thus sequentially aligned with the magnets 63 and 64 and an alternating half cycle signal is generated each time an air gap 65–66 passes a coil 32. As the magnets 63 and 64 are oppositely polarized, the adjacent coils 32 are also oppositely wound and connected such that the output of the coils are added to give a total voltage and current. Successive half cycles generated in each coil 32 are of opposite polarity as the rotor rotates to generate a generally sinusoidal alternating current output. The alternating current output is rectified by the rectifier 7 to produce a suitable D.C. power for charging a battery or the alternating output may be D.C. regulated to power running lights. The field of the power magnet 30 includes leakage into the plane of ignition section 20 and includes a corresponding voltage and current in the charging coils 22 and in the timing coil 23. The ripple or induced voltage in the charging coils 22 does not effect the proper charging of the capacitor 10 and 11 to the proper voltage level. However, a superimposed voltage on the trigger coil 23 may effect the timing and firing of the engine by changing of the trigger pulse position relative to the crankshaft position. The inventor has found however that the power and ignition sections 20 and 21 may be mounted with leakage cross-magnetization by constructing the power section 21 to induce a symmetrical leakage or ripple signal on the desired trigger signal, as shown in FIG. 6. Thus, any charges resulting from the leakage signal similarly effects and changes every trigger signal. This will then maintain good symmetry in the effect on the timing of the two cylinders and permit the porper setting of the position of trigger coil 23 to maintain proper and efficient engine operation. The power magnet 30 thus includes an odd multiple of the number of magnets in ignition magnet 33. In the illustrated embodiment, magnet unit 30 includes fourteen poles 63–64, as shown in FIG. 5, formed in the magnetic strip and thus a multiple of seven of the two magnets of the ignition section 20. The even number of poles or flux reversals of the magnet 30 induces a ripple voltage in the ignition section 20 which similarly effects each trigger signal and may therefor, be coupled to the ignition section without adverse effect on the ignition and particularly the timing. This permits construction of compact alternator with the dual generating sections in close proximity within the cup shaped flywheel.

The present invention thus provides a small, compact dual alternator construction for powering an ignition system and a power load and which can be economically produced. The alternator construction is uniquely adapted for use in structures having relatively severe space limitations such as low horsepower outboard motors and the like.

Various modes of carrying out the invention are contemplated as being within the scope of the following claims, particularly pointing out and distinctly claiming the subject matter which is regarded as the invention.

I claim:

1. An alternator apparatus for a capacitor discharge ignition circuit having an ignition capacitor connected in a discharging circuit including a triggered switch means and for a separate power load, comprising a rotor means having first ignition magnet means having a plurality of circumferentially spaced magnets for providing an output for operating of the ignition circuit and a second power magnet means having a different and greater plurality of circumferentially spaced magnets for producing an alternating current power output, a common rotating support having an axis of rotation and having said first and second magnet means mounted thereon in axially close spaced relation, ignition charging and trigger coil means secured in radial alignment with said first ignition magnet means to produce time spaced trigger signals and coupled by leakage flux to said second power magnet means, a power coil means secured in radial alignment with said second power magnet means, and said second power magnet means including said plurality of magnets selected to produce leakage flux coupled to said ignition charging and trigger coil means creating a symmetrical ripple voltage in the trigger coil means and thereby maintaining symmetrical trigger signals from the trigger coil means and thereby a symmetrical ignition timing characteristic.

2. The alternator apparatus of claim 1 wherein said rotor means includes a cylindrical rotor member formed of magnetic material, said second magnet means including a substantially greater number of magnets than said first magnet means.

3. The alternator apparatus of claim 1 wherein said second power magnet includes fourteen magnets and said first ignition magnet means includes two magnets.

4. The alternator apparatus of claim 1 having a pair of trigger switch means for alternate firing of two cylinders of two cylinder, two cycle engines, wherein said circumferentially spaced magnets of said power magnet means includes a substantial multiple of the number of magnets of the ignition magnet means, said coil means includes a separate trigger coil having the opposite ends connected one each to each of said switch means.

5. The alternator apparatus of claim 4 wherein said ignition charging and trigger coil means includes a pair of charging coils spaced by 180°, said ignition magnet means including a single pair of magnets defining a pair of flux reversal positions simultaneously aligned with the charging coils and one of which is shortly thereafter aligned with the trigger coil, said power magnet means includes fourteen magnets and said power coil means includes five coils spaced in accordance with five adjacent power magnets.

6. The alternator apparatus of claim 1 including a cup-shaped flywheel member having an annular continuous skirt wall, said first and second magnet means having the corresponding magnets secured to the interior skirt wall, and a spacer located between said magnets of said first and second magnets means.

7. The alternator apparatus of claim 6 wherein said magnets of said second power magnet means is a substantial multiple of the number of magnets of said first ignition magnet means.

8. The alternator apparatus of claim 7 wherein said second power magnet means includes fourteen magnets, and said first ignition magnet means includes two magnets.

9. The alternator apparatus of claim 1 wherein the capacitor discharge ignition circuit includes a first and second ignition capacitors, said charging and trigger coil means including separate charging coil means and trigger coil means, diode means connecting the capacitors across the charging coil means for charging of the first capacitor from the first polarity pulses and the second capacitor from the second polarity pulses, individual gate input element connected to the opposite end of said trigger coil means for alternate firing.

10. A rotating power source having a rotating input adapted to be connected to the output drive of an internal combustion engine and producing power for firing of the engine ignition means, comprising a cup-shaped flywheel having an outer annular flange, an ignition magnet means including secured within the flange, a power magnet means secured within the flange adjacent the ignition magnet means and axially spaced of the ignition magnet means, said power magnet means including a substantially greater number of magnets than said ignition magnet means, an ignition winding means mounted in alignment with said ignition magnet means and developing a series of ignition power pulses having a speed related frequency, a power winding means radially aligned with the power magnet means and having a substantial number of poles and creating an alternating current output having a substantially higher frequency than said speed related frequency of the power pulses, said frequency being determined by the number of power magnets and related to the frequency of the ignition signal, said number of power magnets being selected and arranged relative to the ignition winding such that leakage flux from the power magnet means passing through the ignition means produces a symmetrical superposing of a power frequency signal on the ignition power pulses in said ignition winding means.

11. The rotating power source of claim 10 wherein said ignition winding means includes a plurality of ignition power windings connected to produce an ignition power output and a gated switch means for coupling said windings to the ignition means and having a trigger winding connected to said gated switch means, said auxiliary power magnets producing said symmetrical power frequency signal in the trigger winding.

12. The power source of claim 11 including a pair of ignition capacitors and a pair of gated switches connected one to each of said capacitors for alternate firing of two cylinders of a two cylinder, two cycle engine, said power magnet means includes magnets which is substantial even multiple of the magnets of the ignition magnet means, said trigger winding having the opposite ends connected one each to each of said switches.

13. The power source apparatus of claim 12 wherein said ignition power winding includes a pair of windings spaced by 180°, said ignition magnet means including a single pair of magnets defining a pair of flux reversal positions simultaneously aligned with the charging windings and one of which is shortly thereafter aligned with the trigger winding.

14. The power source of claim 13 wherein said power magnet means includes fourteen adjacent equicircumferentially spaced power magnets and said power winding means includes five poles and coils spaced in accordance with five adjacent power magnets.

15. In a two cycle, two cylinder internal combustion engine having a first and a second cylinder and having a crankshaft, first and second ignition means for said first and second cylinders, an alternator driven capacitor discharge ignition circuit having first and second ignition capacitor connected to said ignition means having a first and second gated switch means for separately and alternately discharging of said first and second ignition capacitors for firing of the first and a second engine cylinders, a rotor member attached to the crankshaft, an annular ignition magnet means secured to the rotor member, an annular power magnet means secured to the rotor member in axially closed spaced relation to said ignition magnet means, a stator assembly located within said rotor member and having ignition coil means including a pair of charging coils spaced by 180° and a trigger coil mounted between said charging coils and having a power coil means secured in axially spaced relation to the ignition coil means, said coil means being radially aligned with the corresponding annular magnet means, and having speed related signals generated in said coil means in response to the rotating of the aligned magnet means, and said power magnet means establishing a leakage flux passing through said trigger coil and generating a ripple voltage in said trigger coil and superimposed on said trigger signals in symmetrical fashion to maintain the same timing for each cylinder.

16. In the two cycle, two cylinder internal combustion engine of claim 15 wherein said ignition magnet means is a magnetic strip having the opposite 180° segments oppositely polarized and forming flux reversal at the adjacent ends, said annular power magnet means is a magnetic strip having a plurality of oppositely polarized adjacent segments, said plurality being a substantial multiple of two.

17. In the two cycle, two cylinder internal combustion engine of claim 16 wherein said power magnet means includes 14 separate magnets.

18. The engine of claim 17 wherein said power means include five coils spaced in accordance with and five adjacent power magnets.

19. In the internal combustion engine of claim 15 wherein said ignition circuit includes first and second pilot gated switch means connected to actuate said first and second gated switch means and leads connecting the opposite ends of the trigger coil to the first and second pilot gated switch means, and a return bias stabilizing circuit including first and second loading resistors connected one each in each of the leads from said pilot gated switch means to the opposite ends of said trigger coil, said stabilizing circuit further includes a capacitive reverse bias means connected between the trigger leads and to a ground to maintain a preset and fixed firing timing which is independent of speed.

20. In a two cycle, two cylinder internal combustion engine having a crankshaft, an alternator driven capacitor discharge ignition having a first ignition capacitor and a second ignition capacitor connected between a power input means and a reference ground, a first and second ignition gated switch means connected to the corresponding first and second ignition capacitors for firing of the first and second engine cylinders, a first and second pilot gated switch means connected to actuate the first and second ignition gated switch means, a rotor member attached to the crankshaft, an ignition magnet means secured to the rotor member, a stator assembly located within said rotor member and having an ignition coil means for charging said capacitors and a trigger coil, leads connecting the opposite ends of the trigger coil to the first and second pilot gated switch means, and a return bias stabilizing circuit including first and second loading resistors connected one each in each of the leads, said pilot gated switch means to the opposite ends of said trigger coil, said stabilizing circuit further includes a capacitive reverse bias means connected between the trigger leads and to a ground to maintain a preset and fixed firing timing which is independent of speed.

21. The engine of claim 20 wherein said gated switch means are controlled rectifiers having gate to cathode turn-on circuits, the gate to cathode turn-on circuit of the pilot rectifier being conductively connected in series with the gate to cathode turn-on circuit of the ignition rectifier.

* * * * *